US009702506B2

(12) United States Patent
Karlsson et al.

(10) Patent No.: US 9,702,506 B2
(45) Date of Patent: Jul. 11, 2017

(54) LNG TANK

(71) Applicant: WÄRTSILÄ FINLAND OY, Vaasa (FI)

(72) Inventors: Sören Karlsson, Solf (FI); Mathias Jansson, Vasa (FI); Martin Råholm, Solf (FI); Ingvar Öst, Korsholm (FI)

(73) Assignee: WARTSILA FINLAND OY, Vaasa (FI)

( * ) Notice: Subject to any disclaimer, the term of this patent is extended or adjusted under 35 U.S.C. 154(b) by 221 days.

(21) Appl. No.: 14/473,784

(22) Filed: Aug. 29, 2014

(65) Prior Publication Data

US 2015/0027137 A1 Jan. 29, 2015

Related U.S. Application Data

(63) Continuation of application No. PCT/FI2013/050021, filed on Jan. 10, 2013.

(30) Foreign Application Priority Data

Feb. 29, 2012 (FI) ..... 20125227

(51) Int. Cl.
*F17C 3/00* (2006.01)
*F17C 3/08* (2006.01)
(Continued)

(52) U.S. Cl.
CPC ..... *F17C 13/082* (2013.01); *F17C 7/02* (2013.01); *F17C 13/004* (2013.01);
(Continued)

(58) Field of Classification Search
CPC ..... F17C 2270/0105; F17C 2270/011; F17C 2270/0113; F17C 2203/0619;
(Continued)

(56) References Cited

U.S. PATENT DOCUMENTS 4,510,758 A 4/1985 Tench, Jr.
4,944,155 A 7/1990 Alexander
(Continued)

FOREIGN PATENT DOCUMENTS

DE 8305747 U1 2/1984
WO WO 2006/080853 A1 8/2006
(Continued)

OTHER PUBLICATIONS

International Search Report (PCT/ISA/210) mailed on Apr. 22, 2013, by the European Patent Office as the International Searching Authority for International Application No. PCT/FI2013/050021.
(Continued)

*Primary Examiner* — Ryan J Walters
*Assistant Examiner* — Erik Mendoza-Wilkenfe
(74) *Attorney, Agent, or Firm* — Buchanan Ingersoll & Rooney PC

(57) ABSTRACT

An LNG tank as disclosed can include an inner shell of stainless steel and an outer shell spaced at a distance from the inner shell, the inner and outer shells defining an isolation space therebetween. A double-walled pipe of stainless steel connected to the LNG tank can include an inner pipe. The outer wall of the pipe can be connected to the inner shell by a bellows-like pipe fitting welded to the outer wall of the pipe(s) and to the inner shell of the tank. The inner pipe for extending into a tank room can be connected to a valve in a valve block, and the outer wall of the pipe extending into the tank room can be welded to the valve block to provide a continuous secondary barrier for the inner pipe between the inner shell of the tank and the valve block.

6 Claims, 4 Drawing Sheets

(51) Int. Cl.

| | |
|---|---|
| ***F17C 3/04*** | (2006.01) |
| ***F17C 13/04*** | (2006.01) |
| ***F17C 13/08*** | (2006.01) |
| ***F17C 13/00*** | (2006.01) |
| ***F17C 7/02*** | (2006.01) |

(52) U.S. Cl.
CPC *F17C 2201/0109* (2013.01); *F17C 2201/035* (2013.01); *F17C 2201/054* (2013.01); *F17C 2203/0341* (2013.01); *F17C 2203/0391* (2013.01); *F17C 2203/0629* (2013.01); *F17C 2203/0639* (2013.01); *F17C 2203/0643* (2013.01); *F17C 2205/0323* (2013.01); *F17C 2205/0332* (2013.01); *F17C 2205/0355* (2013.01); *F17C 2205/0385* (2013.01); *F17C 2205/0388* (2013.01); *F17C 2221/033* (2013.01); *F17C 2223/0161* (2013.01); *F17C 2223/033* (2013.01); *F17C 2223/035* (2013.01); *F17C 2223/046* (2013.01); *F17C 2225/0123* (2013.01); *F17C 2225/033* (2013.01); *F17C 2227/0393* (2013.01); *F17C 2260/036* (2013.01); *F17C 2265/066* (2013.01); *F17C 2270/0105* (2013.01)

(58) Field of Classification Search
CPC ..... F17C 2203/0621; F17C 2203/0624; F17C 2203/0643; F17C 2205/0382
USPC ..... 138/111, 114, 115; 220/560.06, 560.07, 220/560.11
See application file for complete search history.

(56) References Cited

U.S. PATENT DOCUMENTS

| | | | | |
|---|---|---|---|---|
| 5,533,340 | A * | 7/1996 | Shama | F17C 3/08 220/901 |
| 2002/0089177 | A1* | 7/2002 | Bonn | F16L 7/02 285/123.5 |
| 2009/0071173 | A1 | 3/2009 | Eide | |
| 2010/0108687 | A1* | 5/2010 | Adkins | F17C 1/02 220/560.07 |
| 2010/0229573 | A1 | 9/2010 | Ehrström | |
| 2013/0187374 | A1 | 7/2013 | Karlsson | |

FOREIGN PATENT DOCUMENTS

| | | |
|---|---|---|
| WO | WO 2009/068731 A2 | 6/2009 |
| WO | WO 2012/032219 A1 | 3/2012 |

OTHER PUBLICATIONS

Written Opinion (PCT/ISA/237) mailed on Apr. 22, 2013, by the European Patent Office as the International Searching Authority for International Application No. PCT/FI2013/050021.
Finnish Search Report for FI 20125227 dated Dec. 13, 2012.

* cited by examiner

LNG TANK

RELATED APPLICATION

This application claims priority as a continuation application under 35 U.S.C. §120 to PCT/FI2013/050021, which was filed as an International Application on Jan. 10, 2013 designating the U.S., and which claims priority to Finnish Application 20125227 filed in Finland on Feb. 29, 2012. The entire contents of these applications are hereby incorporated by reference in their entireties.

FIELD

The present disclosure relates to LNG tanks, such as an LNG tank having an inner shell of stainless steel and an outer shell spaced at a distance from the inner shell, the inner and outer shells defining an isolation space therebetween, the LNG tank being provided with at least one double-walled pipe of stainless steel connected to the LNG tank, the at least one double-walled pipe having a common outer wall and at least one inner pipe, the outer wall of the pipe being connected to the inner shell of the tank by a bellows-like pipe fitting of cold resistant material welded to the outer wall of the pipe(s) and to the inner shell of the tank, the at least one double-walled pipe extending into a tank room associated with the tank.

BACKGROUND INFORMATION

The use of LNG (Liquefied Natural Gas) as fuel for marine applications is increasing since it is an efficient way of cutting emissions. Within the next few decades, natural gas (NG) is expected to become the world's fastest growing major energy source. The driving forces behind this development are the depleting known oil reserves, increasing environmental care and the continuous tightening of emission restrictions. All major emissions can be significantly reduced to truly form an environmentally sound solution; the reduction in $CO_2$, for example, is difficult to achieve with known oil-based fuels. NG contains (e.g., consists of) methane (CH4) with minor concentrations of heavier hydrocarbons such as ethane and propane.

In normal ambient conditions NG is a gas, but it can be liquefied by cooling it down to −162° C. In liquid form the specific volume is reduced significantly, which allows a reasonable size of storage tanks relative to energy content. The burning process of NG is clean. Its high hydrogen-to-coal ratio (the highest among the fossil fuels) means lower $CO_2$ emissions compared with oil-based fuels. When NG is liquefied, all sulphur is removed, which means zero SOX emissions. The clean burning properties of NG also significantly reduce NOX and particle emissions compared with oil-based fuels. LNG is not only an environmentally sound solution, but also economically interesting at today's oil prices.

A feasible way of storing NG in ships is in liquid form. In existing ship installations, LNG is stored in cylindrical, double-walled, insulated stainless steel tanks. The tank pressure is defined by specifications of the engines burning the gas and can be less than 5 bar. A higher (e.g., 9 bar) tank design pressure can be selected due to the natural boil-off phenomenon.

FIG. 1 discloses schematically a known LNG installation for a ship 20. LNG is stored in a cylindrically shaped pressurized storage tank 1. The tank can be a stainless steel inner shell, which is designed for an internal pressure, and an outer shell that acts as a secondary barrier. The outer shell can be made of either stainless steel or carbon steel. The tank is insulated with perlite/vacuum.

Reference numeral 24 denotes a bunkering station from which LNG is led to the tank 1 via insulated pipes. The tank room 4 is a stainless steel barrier welded to the outer vessel of the tank 1. The tank room acts as a barrier that prevents damage to the external compartments, and facilitates quick ventilation of the evaporated gas. The LNG from the tank is evaporated and fed via a gas valve unit 21 to the engines. The main engine generators are denoted by reference numeral 22 and the switch gear by reference numeral 23. FIG. 1 is shows an exemplary schematic arrangement for an LNG installation and, therefore, there is no detailed explanation of a control system, thrusters, propulsion units or other implementation features included in ships.

NG is a safe fuel when proper precautions are taken.

In a liquid state LNG is not explosive, nor is it corrosive or toxic. Thus, possible spillages will not cause any lasting contamination, as the liquid will boil to gas. The low temperature, however, is an issue when considering normal ship steel, but this can be avoided by using appropriate materials in LNG systems.

Gaseous NG is lighter than air, which means that in case of a leakage, the gas will disperse upwards and not build up in the ship's bilge. The ignition temperature of NG is relatively high (600° C.) compared with diesel oil (250° C.), and NG is flammable only within a small concentration range from 5% to 15% of air.

The gas fuel system of a ship includes liquid storage tanks, a vaporiser, a gas valve unit, piping and a bunkering system.

The storage tank and associated valves and piping should be located in a space designed to act as a secondary barrier in case of liquid or compressed gas leakage. The material of the bulkheads of this space should have the same design temperature as the gas tank, and the space should be designed to withstand the maximum pressure build-up or, alternatively, pressure relief venting to a safe location (mast) may be provided. The space should be capable of containing a leakage and be thermally isolated so that the surrounding hull is not exposed to unacceptable cooling in case of a leakage of liquid or compressed gas.

The natural gas is delivered to the engines as a gas but stored as a liquid. A 'tank room' is associated with a storage tank and contains the equipment for converting the liquid into a gas for safe delivery to the engines. The tank room is also considered a 'secondary barrier' since the liquid pipes are inside it.

The piping between the LNG tank and the tank room is double-walled and pipes can be arranged to go through the outer shell of the LNG tank and pass into the space between the inner and outer shells of the LNG tank before they are connected to the inner shell, such as by welding. This known arrangement is functional as such but it involves the outer shell of the LNG tank being made of stainless steel since all connections to the inner shell should be inside a stainless steel cover.

SUMMARY

An LNG tank is disclosed, comprising: an inner shell of stainless steel; an outer shell spaced at a distance from the inner shell, the inner and outer shells defining an isolation space therebetween; at least one double-walled pipe of stainless steel connected to the LNG tank, the at least one double-walled pipe including: a common outer wall, and at least one inner pipe, the at least one double-walled pipe being configured for extending into a tank room associated with the tank, wherein an end of the at least one inner pipe will extend into the tank room, and is connected to a valve means in a valve block, and an end of the outer wall of the pipe for extending into the tank room is connected to the valve block to provide a continuous secondary barrier for the at least one inner pipe between the inner shell of the tank and the valve block.

BRIEF DESCRIPTION OF THE DRAWINGS

Features and advantages disclosed herein will be described more fully with reference to the exemplary embodiments illustrated in the accompanying drawings in which.

DETAILED DESCRIPTION

Figure 1:
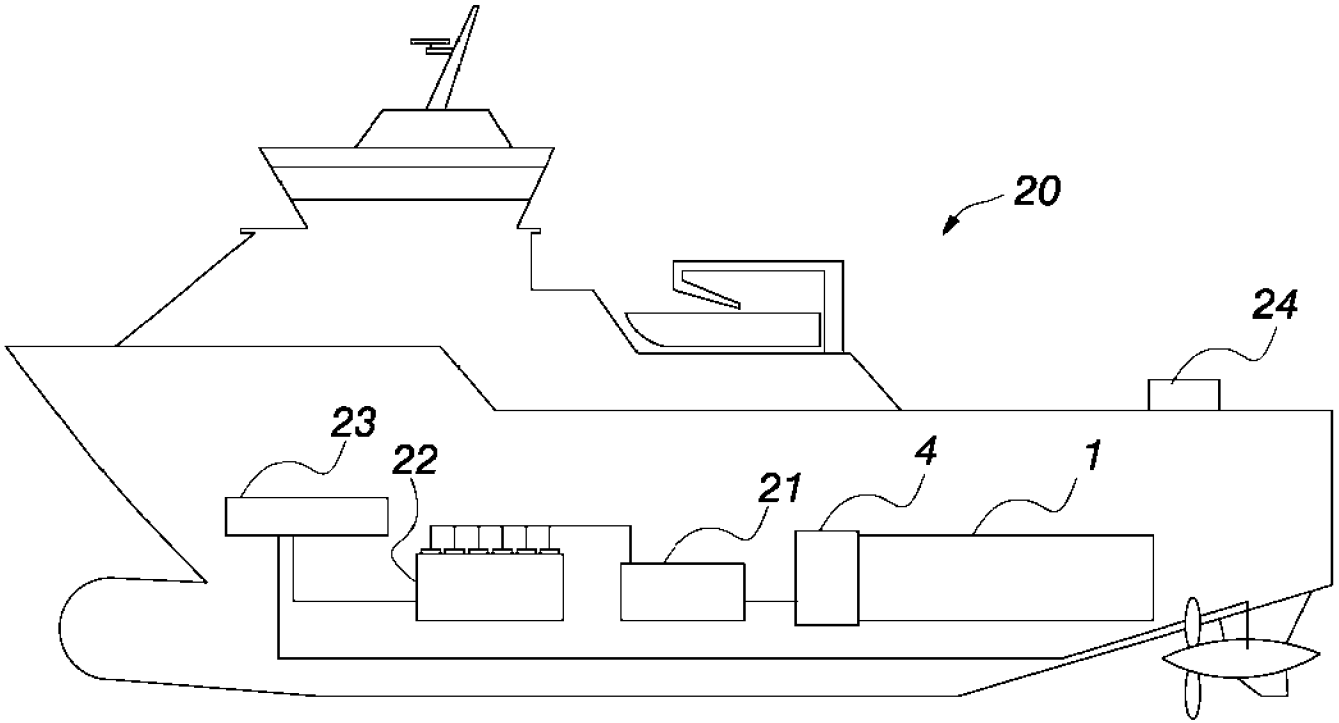
FIG. 1 is an exemplary schematic vertical cross-section of a ship using LNG as fuel.

An LNG tank is disclosed which can have an improved secondary barrier for the pipes extending from the LNG tank to the tank room. This can be achieved by an LNG tank having an inner shell of stainless steel and an outer shell spaced at a distance from the inner shell, the inner and outer shells defining an isolation space therebetween, the LNG tank being provided with at least one double-walled pipe of stainless steel connected to the LNG tank, the at least one double-walled pipe having a common outer wall and at least one inner pipe, the outer wall of the pipe being connected to the inner shell of the tank by means of a bellows-like pipe fitting of cold resistant material welded to the outer wall of the pipe(s) and to the inner shell of the tank, the at least one double-walled pipe extending into a tank room associated with the tank. According to exemplary embodiments, an end of the at least one inner pipe extending into the tank room can be connected to a valve means in a valve block, and an end of the outer wall of the pipe extending into the tank room can be connected to the valve block to provide a continuous secondary barrier for the at least one inner pipe between the inner shell of the tank and the valve block.

The valve block is for example provided with built-in secondary valve barrier means or connected to a second valve block acting as secondary valve barrier means to inhibit and/or prevent leakage of liquid or compressed gas to the tank room in case of failure of the valve means of the first valve block. By connecting (e.g., by welding) the end of the outer wall of the pipe extending into the tank room to the valve block, the at least one inner pipe is inside a secondary barrier continuously from the inner shell of the LNG tank to the valve block, and any leakage from the inner pipe is contained within this secondary barrier. If there is only one inner pipe, one valve with built-in secondary valve barrier means or two successive valves can be sufficient. Thus, in this application the term "valve block" is intended to cover, for example, both a single valve and several valves in a common block.

Exemplary constructions of the valve means can guarantee that a secondary barrier function is built in. For example, by using a double block and bleed valve construction with monitoring of the condition of the first and the secondary barrier, it is possible to guarantee that any leakage from the inner pipe before the valve or in the first barrier of the valve will not lead to the whole LNG content being emptied into the tank room and causing damage to the instruments inside the tank room. The safety of the system is increased and the material costs for manufacturing the tank room are reduced since the tank room can be made less rigid as it need not be designed to carry the load of the tank room fully filled with liquid LNG.

The materials used for the bellows can be stainless steels, for example austenitic type steels. By using a bellows of stainless steel as a pipe fitting between the inner shell of the LNG tank and the outer wall of the pipe it is possible to absorb relative movement in the piping system due to a difference in temperature between the outer wall of the pipe and the inner shell of the tank.

Figure 2:
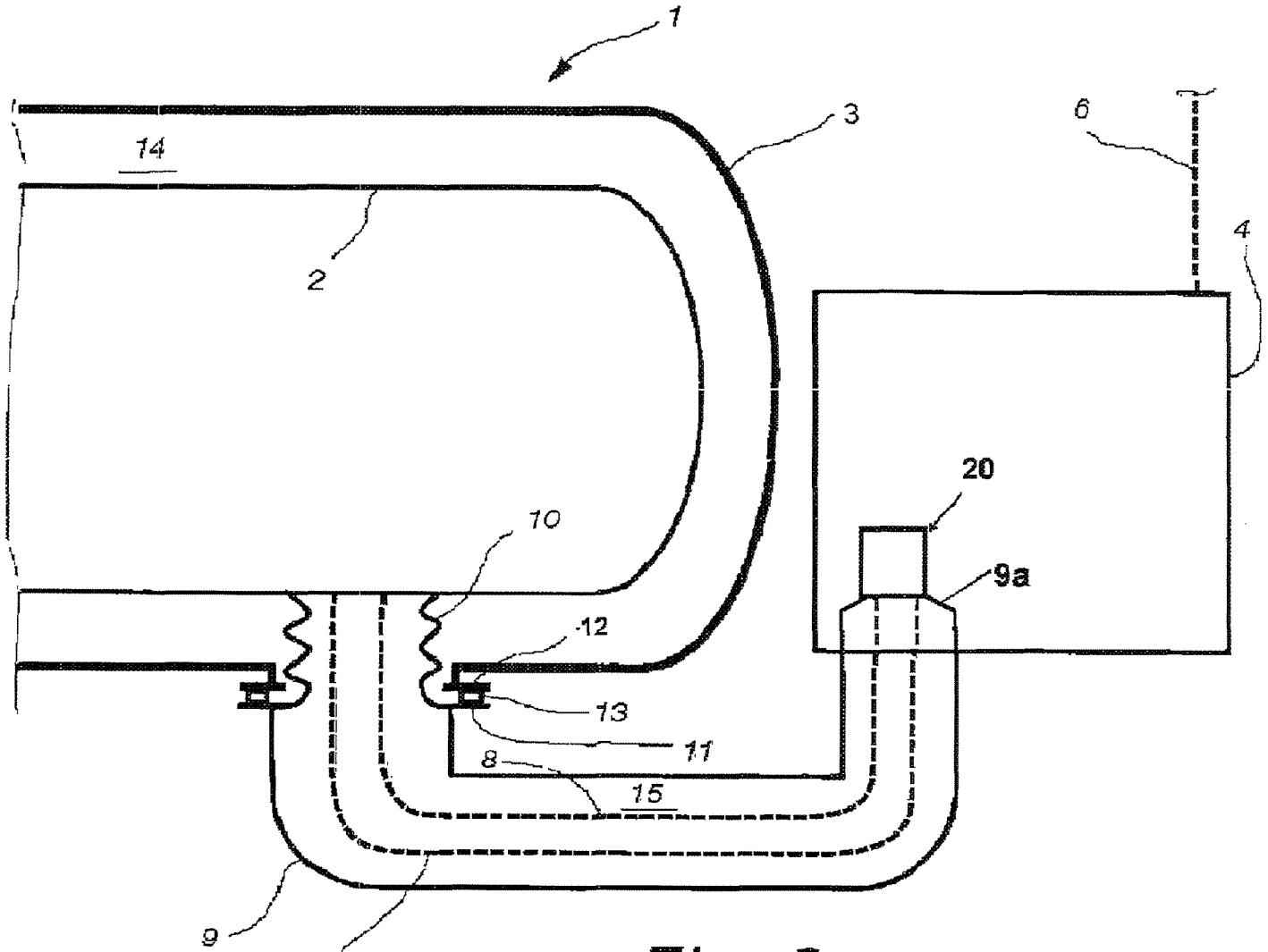
FIG. 2 is an exemplary schematic vertical cross-section of a part of an LNG tank and a tank room associated therewith according to an exemplary embodiment disclosed herein.
Figure 3:
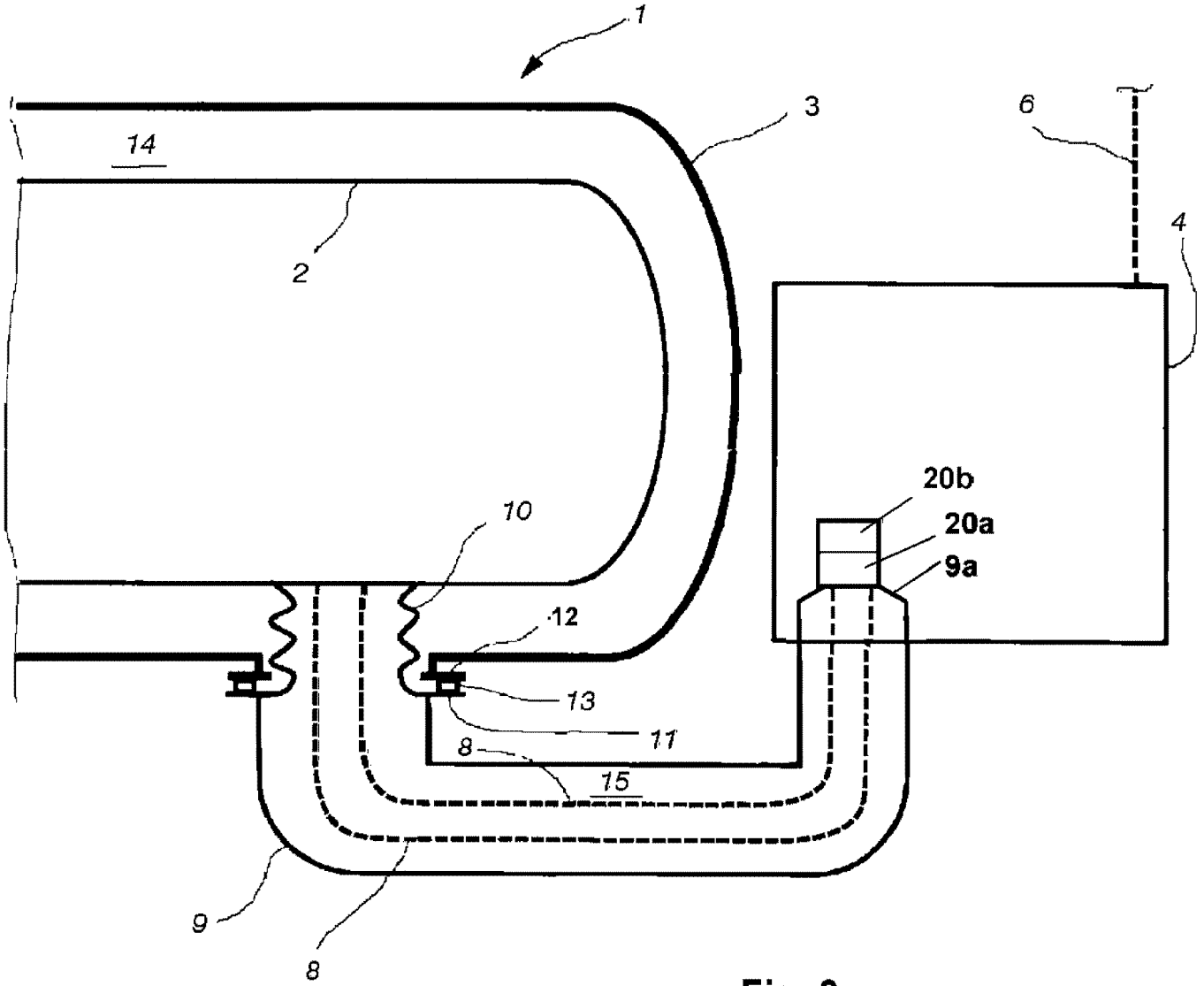
FIG. 3 is an exemplary schematic vertical cross-section of a part of an LNG tank and a tank room associated therewith according to another exemplary embodiment disclosed herein.

Referring to FIGS. 2 and 3, an exemplary LNG tank 1 can include an inner shell 2 and an outer shell 3 defining an isolation space 14 therebetween. The isolation space 14 is under vacuum and/or filled with isolation material, such as perlite or vermiculite. A tank room 4 containing equipment for converting the liquid into a gas for safe delivery to the engines is associated with the tank 1, the equipment being in fluid connection with the tank via double-walled pipes to the tank.

In the schematic illustrations of FIGS. 2 and 3, two inner pipes 8 and a common outer wall 9 therefore are shown. The inner pipes 8 are spaced apart from each other as well as from the outer wall 9 defining an isolation space 15 therebetween. The isolation space 15 can be, similar to the isolation space 14 of the tank 1, under vacuum and/or filled with isolation material, such as perlite or vermiculite.

At one end, the pipes 8 and the outer wall 9 penetrate the tank room and extend over a length inside thereof. The pipes 8 are connected to the valve means of a valve block 20 and the end 9*a* of the outer wall 9 is welded to the valve block 20 enclosing the pipes 8 inside the outer wall 9. The valve block 20 is, for example, provided with built-in secondary valve barrier means (not specifically shown in the drawings) or alternatively, as shown schematically in FIG. 3, two valve blocks 20*a*, 20*b* are arranged successively to provide the secondary barrier means. An exemplary duct mast for ventilation is shown schematically by reference sign 6.

At its other end, the common outer wall 9 of the pipes can be provided with a first connection flange 11 to which a bellows 10 is connected by welding. The bellows 10 is welded at its other end to the inner shell 2 of the tank 1. The inner pipes 8 are welded directly to the inner shell 2 of the tank.

The outer shell 3 of the tank can be provided with a feedthrough opening for the pipe and along the periphery of the opening with a second connection flange 12 extending outwardly from the outer shell 3. The first and second connection flanges can be aligned and provided with an isolation and/or sealing member 13 therebetween when connected together, e.g. by bolts.

The bellows 10 and inner pipes 8 and outer wall 9 can be of cold resistant materials, such as stainless steels, but the material for the outer shell 3 of the tank 1 may be carbon steel due to the use of the protective bellows of stainless steel around the pipe feedthrough to the inside of the tank. The use of carbon steel for the outer shell can substantially reduce the manufacturing costs.

The tank room 4 can also be made of, for example, carbon steel due to the welded connection of the outer wall 9 of the pipes to the valve block 20 and the construction of the valve block including secondary barrier means.

Figure 4:
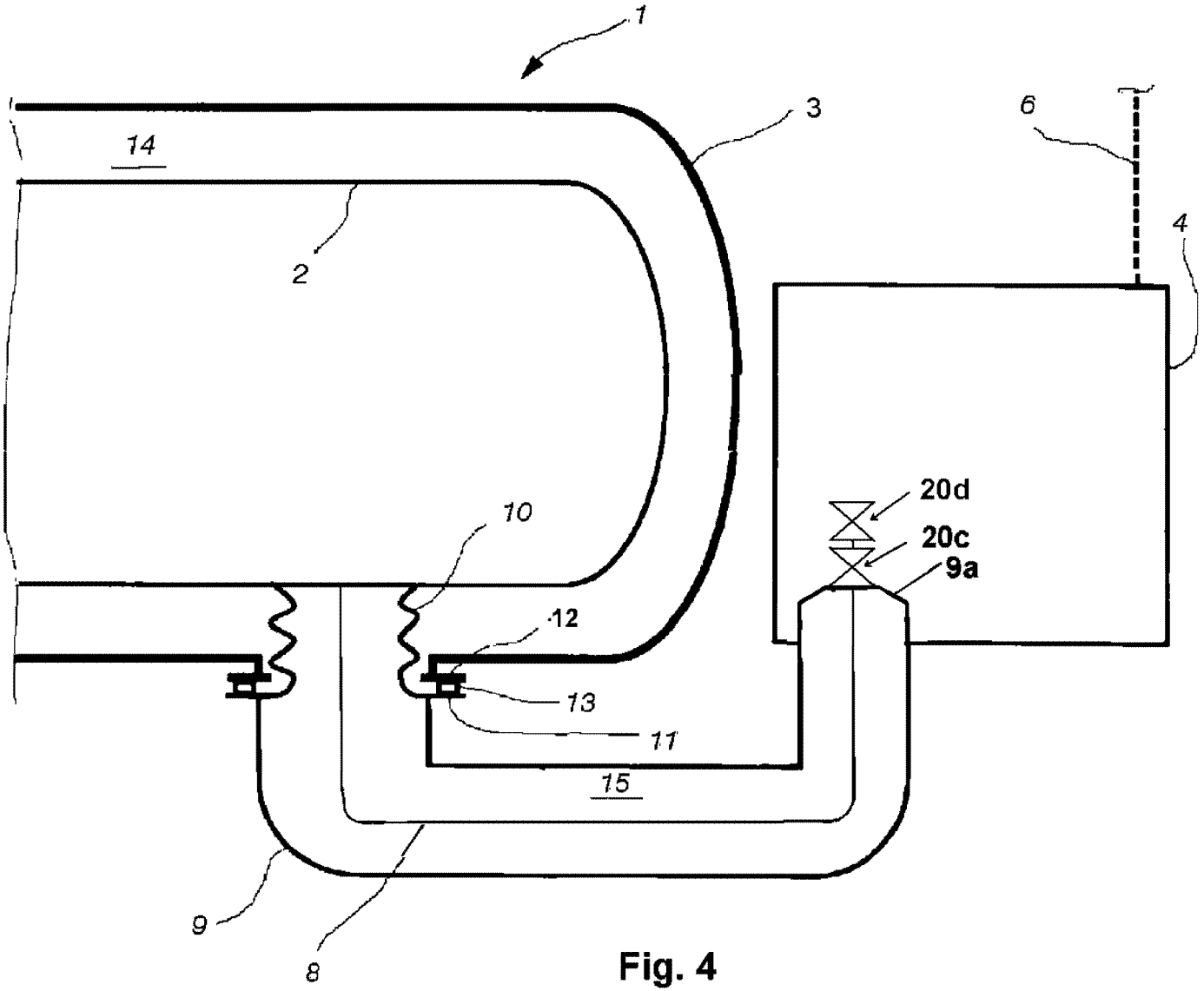
FIG. 4 is an exemplary schematic vertical cross-section of a part of an LNG tank and a tank room associated therewith according to still another exemplary embodiment disclosed herein.

In FIG. 4 shows an exemplary embodiment having only one inner pipe 8 inside the outer wall 9. The inner pipe is connected to a valve seat of the first valve 20*c* and the outer wall 9 is connected, for example, by welding, to the body of the first valve 20*c* to provide a continuous secondary barrier for the inner pipe 8 between the inner shell 2 of the tank 1 and the first valve 20*c*.

A second valve 20*d* can be connected to the first valve to provide secondary barrier means for the valve means. It is also possible to provide the first valve 20*c* with built-in secondary barrier means to omit the second valve 20*d*.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. An LNG tank, comprising:

an inner shell of stainless steel;

an outer shell spaced at a distance from the inner shell, the inner and outer shells defining an isolation space therebetween;

at least one double-walled pipe of stainless steel connected to the LNG tank, the at least one double-walled pipe including:

a common outer wall, and at least one inner pipe, the at least one double-walled pipe being configured for extending into a tank room associated with the tank, wherein an end of the at least one inner pipe being configured to extend into the tank room, and is connected to a valve in a valve block, and an end of the outer wall of the double-walled pipe being configured for extending into the tank room is connected to the valve block to provide a continuous secondary barrier for the at least one inner pipe between the inner shell of the LNG tank and the valve block wherein the tank room is an enclosed space connected to the LNG tank and is configured to contain LNG and natural gas.

2. The LNG tank of claim 1, wherein the valve block comprises: a built-in secondary valve barrier.

3. The LNG tank of claim 1, wherein the valve block is connected to a second valve block to prevent leakage of liquid or compressed gas to the tank room in case of failure of the valve of the valve block.

4. The LNG tank of claim 1, wherein the tank room includes equipment for converting the LNG into a gas for delivery to an engine.

5. The LNG tank of claim 1, wherein the tank room is made of stainless steel or carbon steel.

6. The LNG tank of claim 1, wherein the tank room is welded to the LNG tank.

* * * * *